US008480212B2

(12) United States Patent
Tsukuda et al.

(10) Patent No.: US 8,480,212 B2
(45) Date of Patent: Jul. 9, 2013

(54) PRINTING APPARATUS

(75) Inventors: Masakazu Tsukuda, Tokyo (JP); Tetsuya Ishikawa, Yokohama (JP); Kanto Kurasawa, Yokohama (JP); Yoshitaka Okamura, Yamato (JP); Takashi Nojima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 364 days.

(21) Appl. No.: 12/876,773

(22) Filed: Sep. 7, 2010

(65) Prior Publication Data

US 2011/0063383 A1 Mar. 17, 2011

(30) Foreign Application Priority Data

Sep. 11, 2009 (JP) ..... 2009-210364

(51) Int. Cl.
*B41J 2/175* (2006.01)

(52) U.S. Cl.
USPC ..... 347/85

(58) Field of Classification Search
USPC ..... 347/66, 84, 85, 86, 87
See application file for complete search history.

(56) References Cited

U.S. PATENT DOCUMENTS

| | | | | |
|---|---|---|---|---|
| 5,138,343 | A | 8/1992 | Aichi et al. | 346/140 R |
| 5,153,613 | A | 10/1992 | Yamaguchi et al. | 346/140 R |
| 5,751,301 | A | 5/1998 | Saikawa et al. | 347/8 |
| 6,733,114 | B2 * | 5/2004 | Kobayashi et al. | 347/85 |
| 6,769,763 | B2 | 8/2004 | Kurata et al. | 347/85 |
| 7,344,230 | B2 * | 3/2008 | Moynihan | 347/85 |
| 7,547,097 | B2 * | 6/2009 | Tsukada et al. | 347/85 |
| 7,887,167 | B2 * | 2/2011 | Comas et al. | 347/85 |

FOREIGN PATENT DOCUMENTS

JP 2004-249651 9/2004

* cited by examiner

*Primary Examiner* — Anh T. N. Vo
(74) *Attorney, Agent, or Firm* — Fitzpatrick, Cella, Harper & Scinto

(57) ABSTRACT

A fail-safe capability is realized that not only forestalls the execution by the user of the head replacement operation in an erroneous sequence while the printing apparatus is in operation but also prevents the splashing of ink even if the user attempts to inadvertently replace the print head. For this purpose, the ink supply and the opening and closing of the print head replacement cover are performed by a predetermined rotation of one drive source.

15 Claims, 11 Drawing Sheets

| | PUMP | HEAD REPLACEMENT COVER | STIR |
|---|---|---|---|
| 1ST ROTATION DIRECTION | AIR SUPPLIED | CLOSE | OFF |
| 2ND ROTATION DIRECTION | AIR NOT SUPPLIED | OPEN | ON |

FIG.13

PRINTING APPARATUS

BACKGROUND OF THE INVENTION

1. Field of the Invention

The present invention relates to a printing apparatus having an ink supply device with tubes for supplying ink from ink tanks to a print head.

2. Description of the Related Art

There is an inkjet printing apparatus which has its print head on a carriage connected with ink tanks through supply tubes so as to keep the print head supplied with inks from the ink tanks by using a desired type of pump. Japanese Patent Laid-Open No. 2004-249651 discloses a construction in which an operation of a control unit that controls the ink supply unit and an operation to open a cover of the ink tanks are carried out independently of each other. During a printing operation, the ink tank cover is closed so that the user cannot open the ink tank cover, preventing the ink tanks from being removed or inserted undesirably.

With the apparatus of Japanese Patent Laid-Open No. 2004-249651, in the event of a failure of the control unit for opening the cover of the ink tanks, the user manually opens the ink tank cover to replace the ink tanks. In that case, if after removing the ink tank the user further takes out the print head, members forming an ink path communicate with open air, giving rise to a possibility that ink may get scattered from the members making up the ink path, which in turn may result in ink adhering to the user or print sheet.

SUMMARY OF THE INVENTION

The present invention has been accomplished in light of the above problems. This invention is intended to provide a fail-safe capability that not only forestalls the execution by the user of the head replacement operation in an erroneous sequence while the printing apparatus is in operation but also prevents the splashing of ink even if the user inadvertently attempts to replace the print head.

A printing apparatus of this invention comprises: a carriage capable of mounting an ink ejecting print head; an ink storage device for storing the ink; an ink supply device to supply the ink from the ink storage device to the print head by activating a drive source to deliver air into the ink storage device for its pressurization; and a cover covering at least a part of a member, the member being adapted to cover the print head when closed; wherein an operation of the drive source causes the cover to be opened and closed; wherein an operation of the drive source causes the ink storage device to be pressurized and the cover to be closed; wherein an operation of the drive source causes the pressure in the ink storage device to be released and the cover to be opened; wherein, when the ink supply device is delivering air to the ink storage device for pressurization, the cover cannot be opened.

With the printing apparatus of this invention, the same drive source as used for the ink supply device is used to perform the operation of opening and closing the cover, the operation of pressurizing the ink storage device and at the same time closing the cover, and the operation of releasing the pressurized air from the ink storage device and at the same time opening the cover. Further, the printing apparatus is characterized in that, when the ink supply device is delivering air into the ink storage device, the cover cannot be opened. This realizes a fail-safe design that not only forestalls the execution by the user of the head replacement operation in an erroneous sequence while the printing apparatus is in operation but also prevents the splashing of ink even if the user inadvertently attempts to replace the print head.

Further features of the present invention will become apparent from the following description of exemplary embodiments (with reference to the attached drawings).

BRIEF DESCRIPTION OF THE DRAWINGS

FIG. 13 shows ink supply operations and states of the print head replacement cover and an agitator according to the direction in which a drive source rotates.

DESCRIPTION OF THE EMBODIMENTS

Embodiments of this invention will be described by referring to the accompanying drawings.

Figure 1:
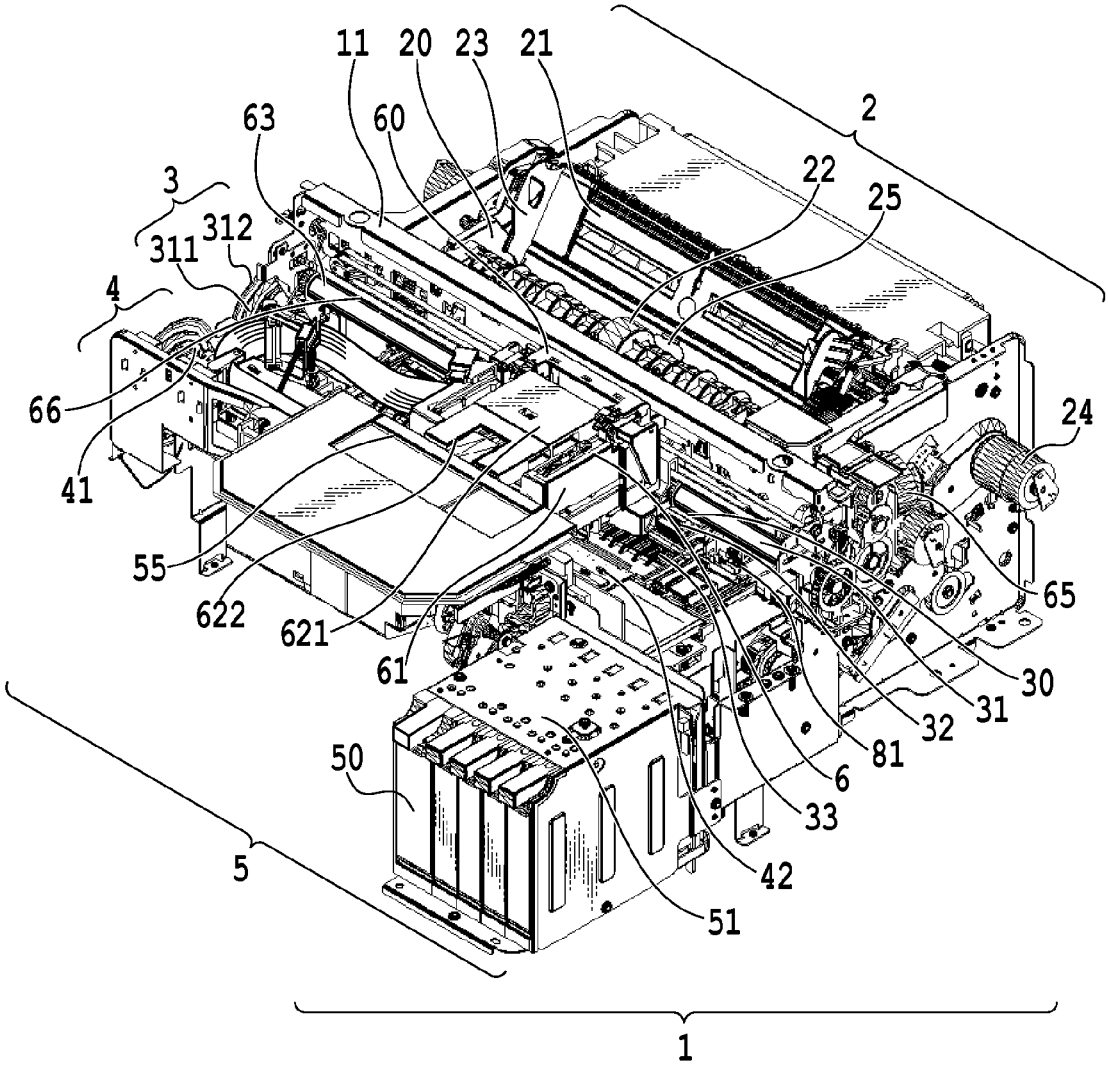
FIG. 1 is a perspective view showing a construction of the printing apparatus.
Figure 2:
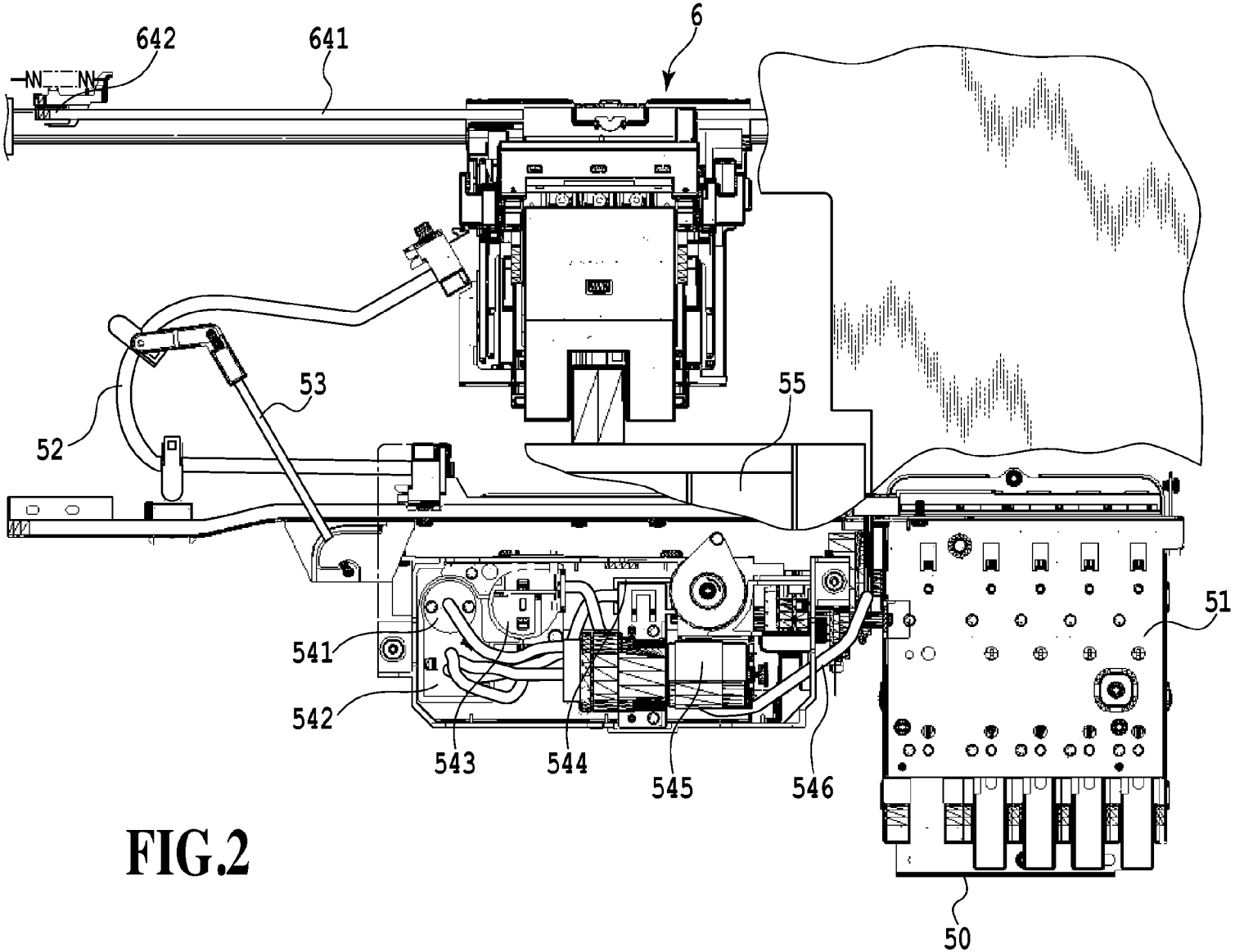
FIG. 2 is a perspective view of a construction showing an ink supply unit and a carriage unit in the printing apparatus.

FIG. 1 is a perspective view showing a construction of an inkjet printing apparatus to which the present invention can be applied; and FIG. 2 is a perspective view showing a construction of the ink supply unit and a carriage unit of the inkjet printing apparatus of FIG. 1. The printing apparatus of FIG. 1 comprises a paper feeding unit 2, a paper conveyance unit 3, a paper discharging unit 4, an ink supply unit 5, a carriage unit 6, a print head 7, a cleaning unit and a control unit.

(Basic Construction)

(Paper Feeding Unit)

The paper feeding unit 2 comprises a pressure plate 21 on which to stack sheets of print medium, a paper feed roller 22 to feed sheets of print medium, a separation roller to separate individual sheets from the stack and a return lever to bring the print medium to the stacked position, all mounted on a base 20. A paper feed tray to hold the stack of the print medium sheets in position is mounted to the base 20 or an enclosure. The paper feed roller 22 is a rod which, shaped like an arc in cross section and provided with one separation roller rubber, feeds sheets of the print medium. A driving force for the paper feed roller 22 is transmitted through a gear train from a motor (AP motor) 24 installed in the paper feeding unit 2, which is commonly used also for a cleaning unit not shown. The pressure plate 21 is provided with a movable side guide 23 which restricts the stacking position of the print medium.

The pressure plate 21 is rotatable about its rotation axis fitted in the base 20 and is biased against the paper feed roller 22 by a pressure plate spring. At a position on the pressure plate 21 facing the paper feed roller 22 is installed a separation seat 25 formed of a material of a large friction coefficient, such as an artificial leather, which prevents the print medium near the end of the paper stack from being fed in blocks of multiple sheets. The pressure plate 21 is constructed to be brought into and out of contact with the paper feed roller 22 by a pressure plate cam. Further, also installed on the base 20 is a separation roller holder that has a separation roller to separate the print medium one sheet at a time and which is rotatable about its rotation axis and biased against the paper feed roller 22 by a separation roller spring. The return lever to return the print medium to the stack position is rotatably fitted to the base 20 and biased in a release direction by a return lever spring.

In a normal standby state, the pressure plate 21 is released by the pressure plate cam and the separation roller is released by the control cam. The return lever is installed at the stack position so that it can cover a paper stack opening to prevent the print medium sheets from being pushed down beyond their position when stacked. When, with the print medium stacked, the paper feeding operation starts, the motor drives the separation roller to come into contact with the paper feed roller 22. Then, the return lever is released to bring the pressure plate 21 into contact with the paper feed roller 22. In this state the print medium begins to be fed. The print medium is restricted by a front stage separation unit installed in the base 20 so that only a predetermined number of sheets is fed to a nip portion formed by the paper feed roller 22 and the separation roller. The sheets thus fed are separated by the nip portion, with only the top sheet carried further on. When the sheet reaches a conveyance roller 31 and a pinch roller 32, the pressure plate 21 and the separation roller are returned to the stack position by the pressure plate cam and the control cam, respectively. At this time, the print medium that has reached the nip portion formed by the paper feed roller 22 and the separation roller can be returned to the stack position.

(Paper Conveyance Unit)

The paper conveyance unit 3 is mounted to a chassis 11 formed of a bent and worked metal plate and has a conveyance roller 31 for moving a print medium and a PE sensor. The conveyance roller 31 has its metal shaft coated over its surface with fine ceramic particles and also has metal portions at its both ends supported by bearings in the chassis 11. The PE sensor is an optical sensor to detect the front and rear ends of the print medium and output a signal for control of the conveyance of the print medium. The conveyance roller 31 has a plurality of follower pinch rollers 32 rotating in contact with it. The pinch rollers 32 are held in a pinch roller holder 30 and biased by pinch roller springs against the conveyance roller 31 to produce a traction force to move the print medium. At this time, the pinch roller holder 30 rotates about its rotating shaft supported on bearings in the chassis 11.

At an inlet of the paper conveyance unit 3 to which the print medium is delivered, there is installed a paper guide flapper to guide the print medium, which has passed between the conveyance roller 31 and the pinch rollers 32, onto a platen 33. The pinch roller holder 30 is provided with a PE sensor lever to signal the detection of the front and rear end of the print medium to the PE sensor. The platen 33 is mounted and positioned on the chassis 11. The paper guide flapper is engageable with the conveyance roller 31 and rotatable about sliding bearing portions. It is positioned by coming into contact with the chassis 11.

In such a construction, the print medium carried to the paper conveyance unit 3 is now guided by the pinch roller holder 30 and paper guide flapper to a roller pair made up of the conveyance roller 31 and the pinch rollers 32. At this time, the PE sensor lever detects the front end of the print medium, allowing the print position on the print medium to be determined. The print medium is carried over the platen 33 as the conveyance motor drives the roller pair of the conveyance roller 31 and the pinch rollers 32. The platen 33 has ribs that form a conveyance reference surface used to manage a gap between the print head 7 and the print medium. Further, in combination with the paper discharge unit described later, the platen 33 is also constructed to keep undulations of the print medium minimal.

The conveyance roller 31 is driven by the rotating force of the conveyance motor, or DC motor, being transmitted through a timing belt to a pulley 311 mounted on an axis of the conveyance roller 31. Also installed on the axis of the conveyance roller 31 is a code wheel 312 formed with 150-360 equidistant markings per inch to detect the distance that the print medium has been moved by the conveyance roller 31. An encoder sensor to read the markings on the code wheel 312 is mounted on the chassis 11 at a position adjoining the code wheel 312.

Provided downstream of the conveyance roller 31 in the print medium conveying direction is a print head 7 that forms an mage according to image information. The print head 7 used is an inkjet print head fitted with ink tanks of different colors that are replaceable independently of each other. The inkjet printing system may be chosen from among those using heating elements, piezoelectric elements, electrostatic elements and MEMS elements.

(Paper Discharging Unit)

The paper discharging unit 4 comprises discharge rollers 41, spurs pressed under a specified pressure against the discharge rollers 41 so that they are rotatably driven by it, and a gear train to transmit the driving force of the conveyance roller 31 to the discharge rollers 41. The discharge rollers 41 are mounted to the platen 33. The discharge roller 41 installed on a downstream side of the platen 33 with respect to the print medium conveyance direction has its metal shaft provided with a plurality of rubber portions. This discharge roller 41 is driven by the driving force of the conveyance roller 31 being transmitted to it through an idler gear. The discharge roller 41 installed on an upstream side has its resin shaft provided with a plurality of resilient members of elastomer. This discharge roller 41 is driven by the driving force of the conveyance roller 31 being transmitted to it through an idler gear.

The spurs are made of a thin stainless steel plate with a plurality of protrusions along its circumference, integrally molded with a resin portion and fitted to a spur holder 42. A spur spring made of a bar-like coil spring holds the spur in the spur holder 42 and presses the spur against the discharge roller 41 or the like. The spur spring is installed at positions corresponding to the discharge roller 41 and the rubber portions and resilient portions of the discharge roller 41. One of the functions of the spur spring is to produce a traction force to carry the print medium. The spur spring is also installed where there are no discharge rollers 41 nor their rubber portions or resilient portions, its main function being to keep the print medium from floating when printed.

(Ink Supply Unit)

The ink supply unit 5 comprises an ink tank 50 having an ink storage device, a tank holder 51 in which to set the ink tank 50, and an ink supply tube 52 to supply ink from the ink tank 50 to the carriage unit 6. The ink supply unit 5 also has an ink supply tube support member 53 that restricts the drooping of the ink supply tube 52 and an ink supply/drive unit that drives air into the ink tank to pressurize the ink storage device for ink supply. The ink supply/drive unit has an air supply port 541 to draw in air from outside and a safety valve 54 that opens when an air pressure exceeds a predetermined level. The ink supply/drive unit also has a pressure sensor 543 to control the air pressure, an air pressure release valve 544 such as a solenoid valve, a drive source 545 such as motor, and an air supply tube 546 to deliver air into the ink tank. These air pressure release valve 544 and drive source 545 such as a motor are normally covered with a print head replacement cover 55 that can be opened and closed.

(Carriage Unit)

The carriage unit 6 has a carriage 60 capable of mounting the print head 7, a joint base 61 forming an ink path from the ink supply tube 52 to the print head 7, and a set lever 62 interlocked with the joint base that is used when replacing the print head 7. The carriage 60 is supported by a guide shaft 63, along which the carriage 60 is reciprocally scanned at right angles to the direction in which the print medium is conveyed, and by a guide rail 111 that holds the rear end of the carriage 60 to maintain the gap between the print head 7 and the print medium.

The guide shaft 63 is mounted to the chassis 11, and the guide rail 111 is formed integral with the chassis 11. The carriage 60 is driven by a carriage motor 65 mounted on the chassis 11 through a timing belt 641. The timing belt 641 is stretched and supported by an idle pulley 642. The timing belt 641 and the carriage 60 are coupled together through a damper formed of rubber or the like that attenuates vibrations of the carriage motor 65, thus reducing uneven image being printed. To detect the position of the carriage 60, a code strip 66 formed with 150-300 equidistant markings per inch is laid parallel to the timing belt 641. Further, an encoder sensor to read the code strip 66 is provided in the carriage 60.

In such a construction, when an image is going to be formed on a print medium, the print medium is carried by the roller pair of the conveyance roller 31 and the pinch rollers 32 to a row position (in a direction in which the print medium is conveyed) where the image is to be formed. Further the carriage motor 65 moves the carriage to a column position (in a direction perpendicular to the print medium conveyance direction) where the image is to be formed so that the print head 7 faces the image forming position on the print medium. Then, according to a signal from a printed circuit board, the print head 7 ejects ink onto the print medium to form the image. The print medium formed with the image by the carriage unit 6 is held by the nip portion between the discharge roller 41 and the spurs and carried onto the discharge tray.

(Characteristic Construction)

(Drive Control)

Next, a drive control performed in replacing the print head of the printing apparatus of this embodiment will be explained. This drive control is executed according to a command from a control unit 9. In the following the process of replacing the print head 7 using a printer driver will be described. It should, however, noted that this print head replacement may also be done by the printing apparatus.

Figure 3:
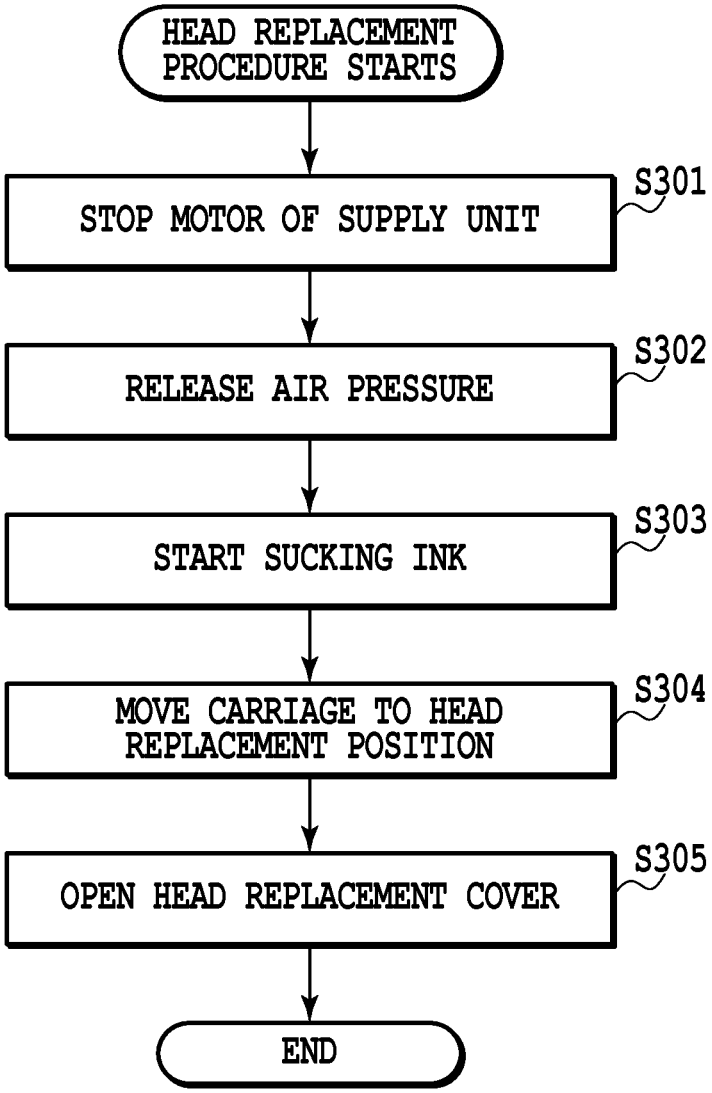
FIG. 3 is a flow chart showing a sequence for replacing a print head.
Figure 4:
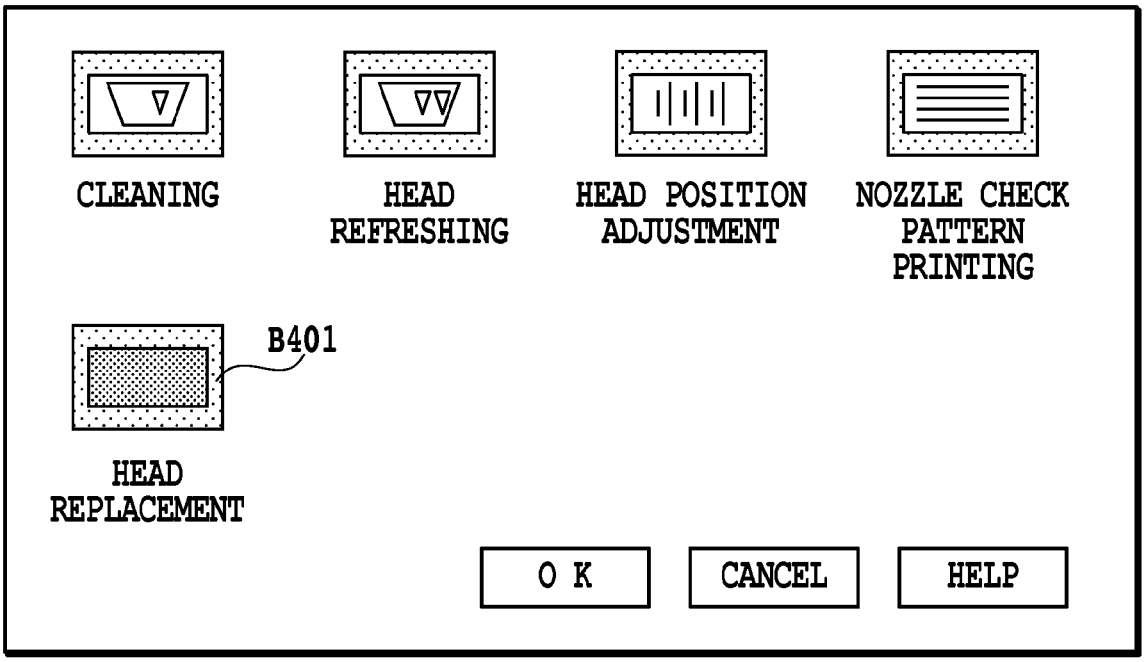
FIG. 4 shows an example of a user interface that the user uses in replacing the print head.

FIG. 3 is a flow chart showing a control sequence in the process of replacing the print head 7. FIG. 4 shows an example of user interface that the user operates when replacing the print head. Now, the sequence of steps for replacing the print head will be explained in reference to the flow chart of FIG. 3. First, when a button B401 for print head replacement shown in FIG. 4 is pressed, the print head replacement sequence is started. Step S301 stops the drive source 545, stopping the supply of air into the ink tank.

Then, the control moves to step S302 where it opens the air pressure release valve 544 to communicate the interior of the air supply tube to the open air. This releases the pressure applied to the air supply tube 546 and the ink tank, stopping the supply of ink from the ink tank to the print head. Although in this embodiment the pressure release to the open air is done by a solenoid valve, the tube may be opened or closed by a cam driven by the drive source 545. Next at step S303, the carriage 60 moves to the cleaning unit which then begins sucking ink from the ink supply tube 52 and the print head 7.

With this suction operation performed, the residual pressure of ink in the ink supply tube 52 and the print head is eliminated at step S304. After the suction operation, the carriage 60 moves to the head replacement position where its print head replacement cover 55 is opened at step S305. With the above sequence of steps completed, the user can replace the print head 7. An access cover not shown which, when open, allows access to the interior of the printing apparatus 1, is provided with a sensor that detects its opening and closing so that the print head replacement sequence can only be executed when the access cover is closed. Then, after the print head replacement sequence is finished, when the access cover is opened and the sensor detects it, the print head replacement cover 55 is opened. It is desirable that a command for the user to open the access cover be issued after the print head replacement sequence is finished, in order to prevent the user from inadvertently coming into contact with the carriage 60.

Figure 5A:
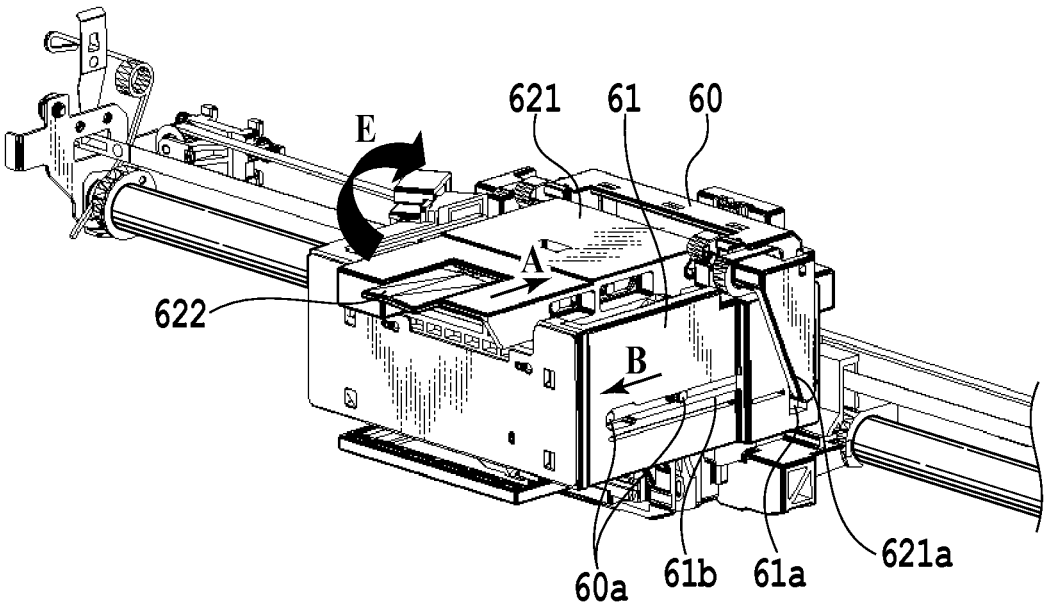
FIG. 5A is a perspective view showing a set lever of the carriage unit in an open state.
Figure 5B:
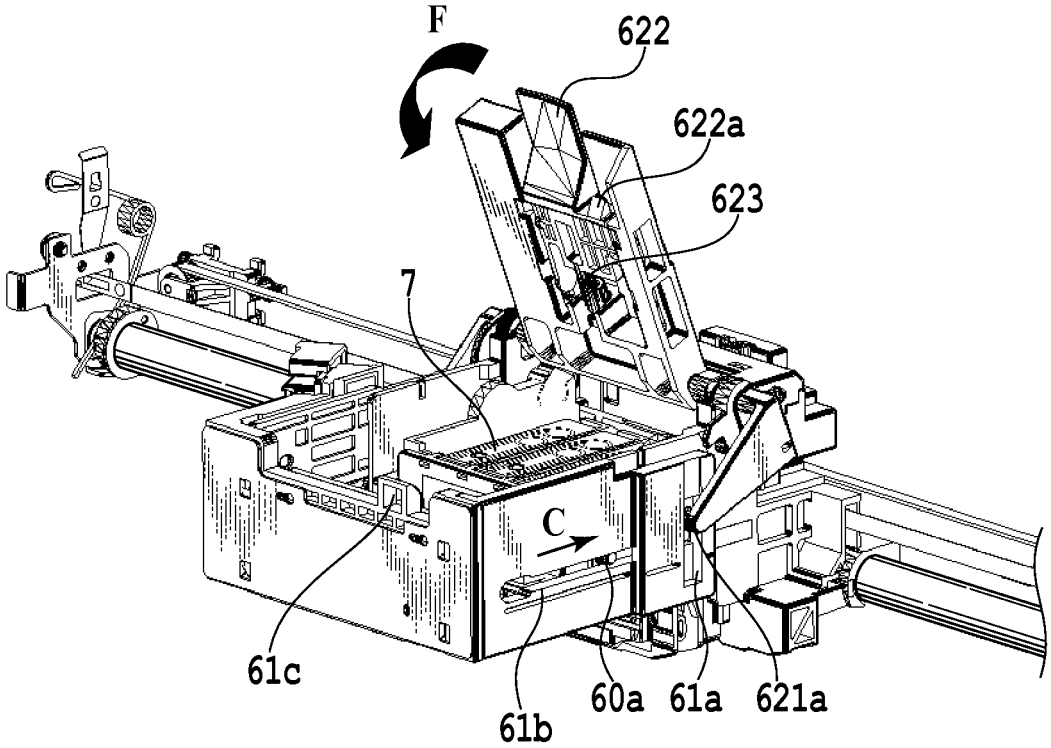
FIG. 5B is a perspective view showing the set lever of the carriage unit in a closed state.

FIG. 5A and FIG. 5B are perspective views showing a set lever of the carriage unit in a cover-closing state and in a cover-opening state. The procedure for replacing the print head 7 will follow. A lever lock 622 is biased by a spring 623 and movably fitted to a set lever 621 (a member covering the print head) in a way that allows the user to push it in a direction of arrow A to open the set lever 621. A joint base 61 is formed with a guide groove 61*a* for guiding a boss 621*a* of the set lever 621 and with a guide groove 61*b* for guiding a guide boss 60*a*.

Here, while pushing the lever lock 622 in the direction of arrow A, the user pivots it in the direction of arrow E. This causes the boss 621*a* attached to the set lever 621 and slidably fitted in the guide groove 61*a* of the joint base 61 to pivot, pushing the joint base 61 in the direction of arrow B. With the opening action of the set lever 621 and the translational movement of the joint base 61 described above, the print head 7 can now be taken out.

Next, after the print head 7 is mounted on the carriage 60, the set lever 621 is rotated in the direction of arrow F. As the boss 621*a* of the set lever 621 pivots, the joint base 61 is retracted in the direction of arrow C until the print head 7 engages the carriage 60. Now, the replacement of the print head 7 is completed. It is noted here that the lever lock 622 is provided with a latch 622*a* and the joint base 61 with a latch groove 61*c* in order to give a good clicking feel so that the user can know when he or she has reliably set the print head 7 on the carriage 60.

Figure 6:
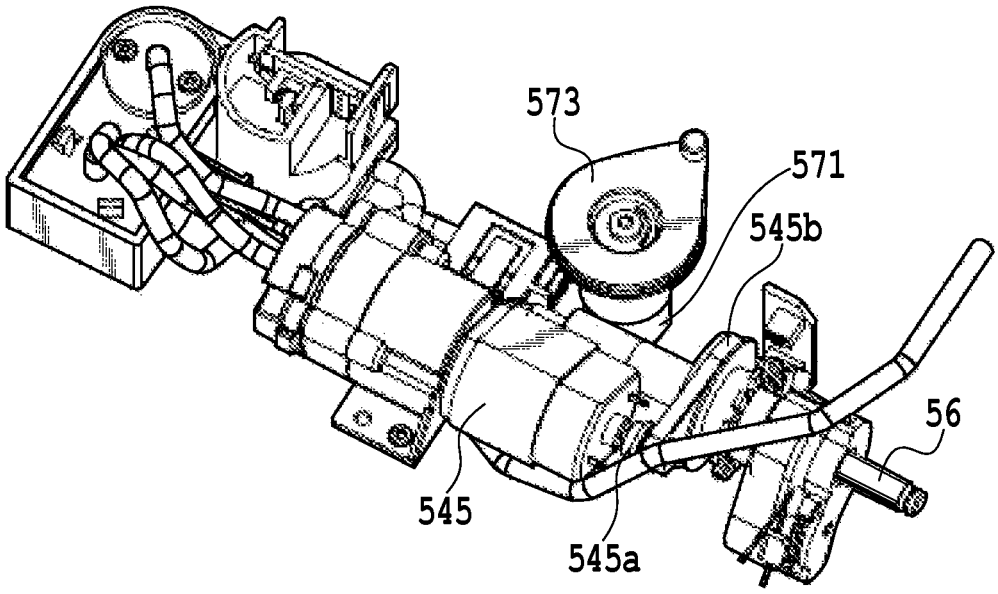
FIG. 6 is a perspective view showing a construction of a drive part of the supply unit.
Figure 7:
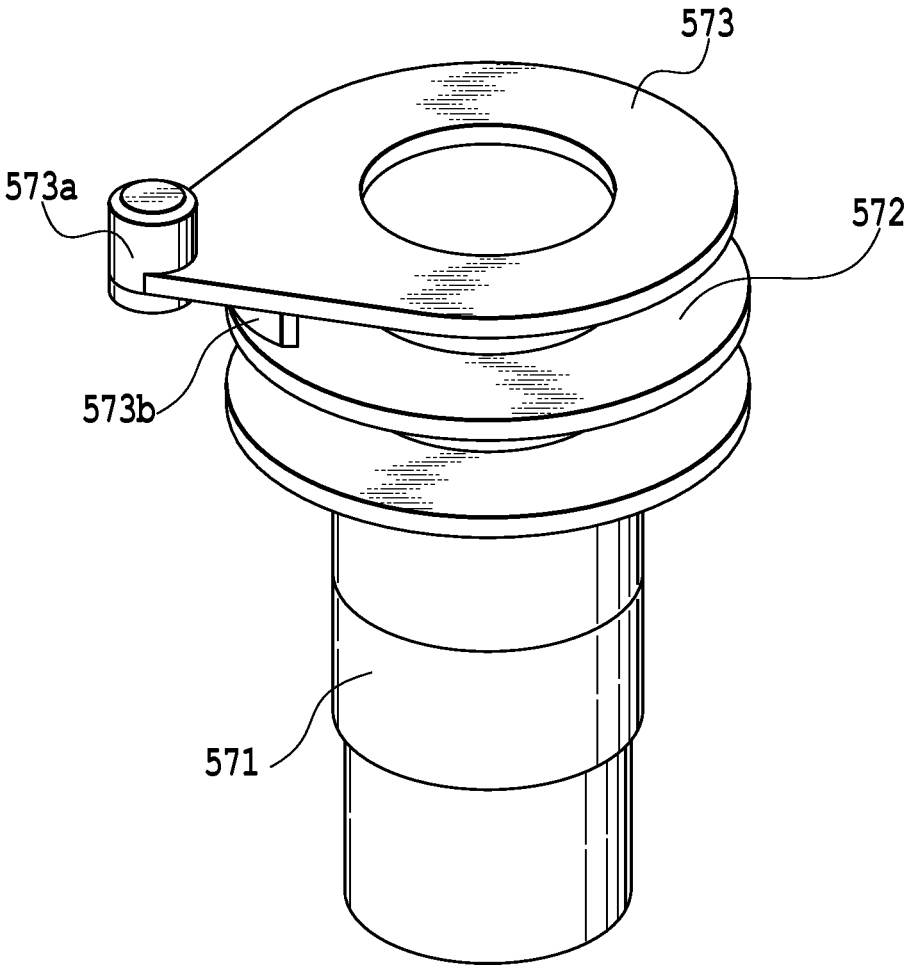
FIG. 7 is a perspective view showing a construction of a print head replacement cover driving unit.
Figure 8:
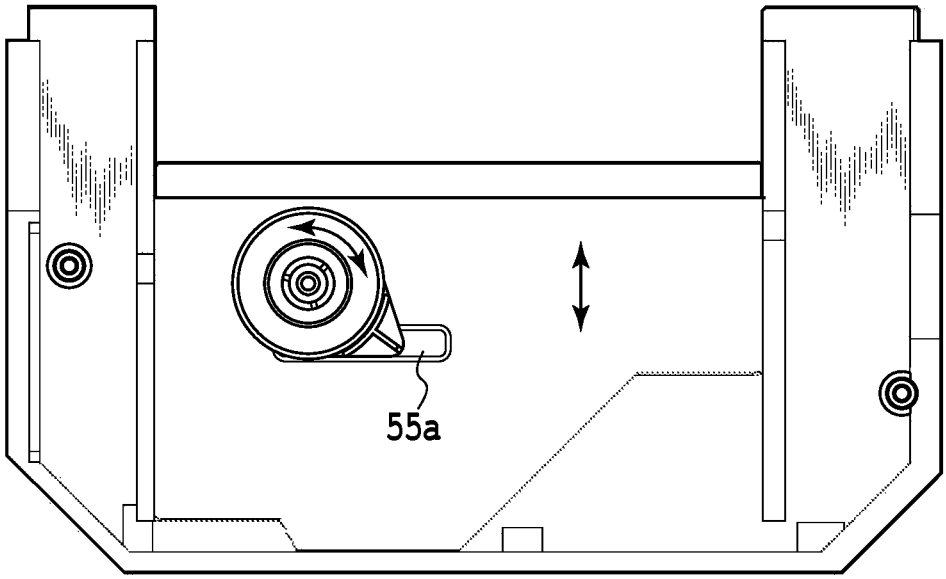
FIG. 8 is a bottom view showing a construction of a print head replacement cover and a print head replacement arm.
Figure 9:
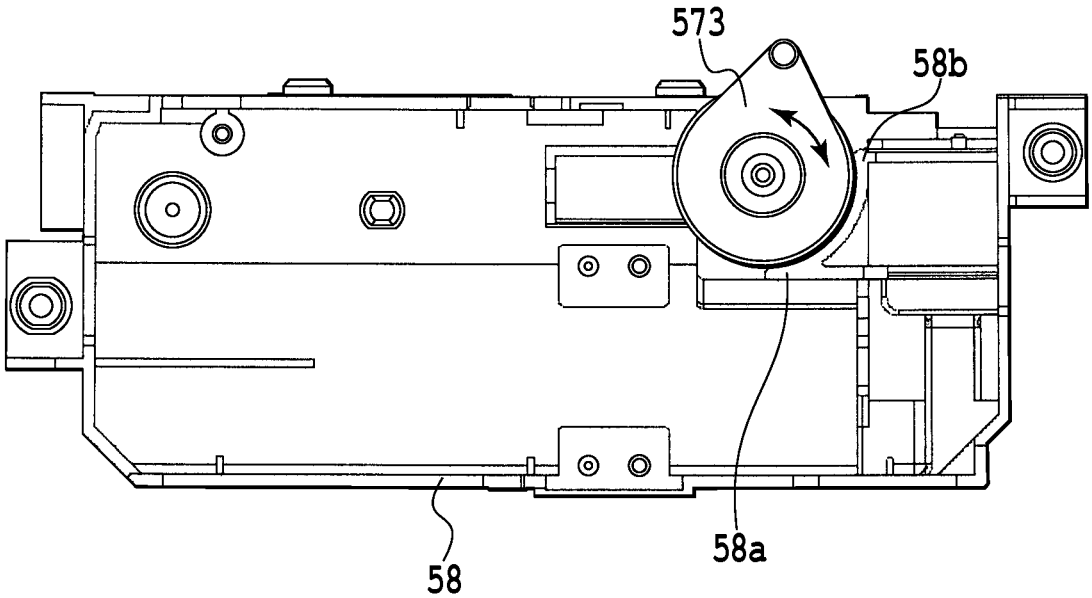
FIG. 9 is a top view showing the print head replacement cover driving unit and a supply unit case.

FIG. 6 is a perspective view showing a construction of the driving portion of the ink supply unit; FIG. 7 is a perspective view showing a construction of the print head replacement cover driving unit; FIG. 8 is a bottom view showing a construction of the print head replacement cover 55 and of a print head replacement arm 573; and FIG. 9 is a top view showing the print head replacement cover driving unit and a supply unit case. The operation of opening and closing the print head replacement cover by the drive source of the ink supply unit will be explained by referring to FIG. 6 to FIG. 9.

In one of two shafts of the drive source 545, which supplies air into the ink tank, is fitted under pressure a drive source pulley 545*a* that transmits a force from the drive source 545 to a print head replacement cover shaft 56 through a drive belt 545*b*. Transmission of the drive force from the print head replacement cover shaft 56 to the print head replacement cover driving unit is made through a bevel gear. The print head replacement cover driving unit comprises a print head replacement drive gear 571, a friction pad 572 and a print head replacement arm 573. The friction pad 572 made of a sponge is secured to the print head replacement drive gear 571. The friction pad 572 may also be formed of rubber.

The print head replacement arm 573 is mounted to the print head replacement drive gear 571 so that it can be rotated through the friction force of the friction pad 572. As a boss 573*a* of the print head replacement arm 573 is rotated to slide through a guide groove 55*a* of the print head replacement cover 55 (see FIG. 8), the print head replacement cover 55 is opened or closed. When the drive source 545 rotates in a first rotation direction, the print head replacement cover 55 is closed and at the same time a drive control of supplying air into the ink tank 50 (pressurizing the interior of the ink tank 50) is activated (first mode).

When the drive source 545 rotates in a second rotation direction, opposite the first direction, the print head replacement cover 55 is opened and at the same time the air pressure release valve 544 is opened stopping the supply of pressurized air (second mode). In the first mode, the pressurized air supplied into the ink tank 50 causes ink to be supplied from the ink tank 50 to the print head 7. As described later, the timing at which to supply ink to the print head 7 is after the print head replacement cover 55 is completely closed.

The first rotation direction of the drive source 545 may be a forward rotation or a backward rotation. When a rib 573*b* of the print head replacement arm 573 engages a rib 58*a* or 58*b* of a supply unit case 58, the movement of the print head replacement arm 573 is restricted, leaving the friction pad 572 and the print head replacement drive gear 571 to continue to rotate slipping past the arm 573. As a result, while the drive source 545 rotates, the print head replacement arm 573 performs a rotating action through only a predetermined range of angle.

This allows the print head replacement cover 55 to keep its closed or open state. The drive force transmission shown in FIG. 6 is one such example. The drive belt 545*b* may be replaced with a gear for a drive force transmission. The use of a friction force of the friction pad 572 in driving the print head replacement cover 55 allows the print head replacement arm 573 to slip and rotate idly on the friction pad 572 also when the user inadvertently comes into contact with the print head replacement cover 55 during operation. This provides a fail-safe construction that prevents the print head replacement cover 55 from trapping a foreign object.

Figure 10:
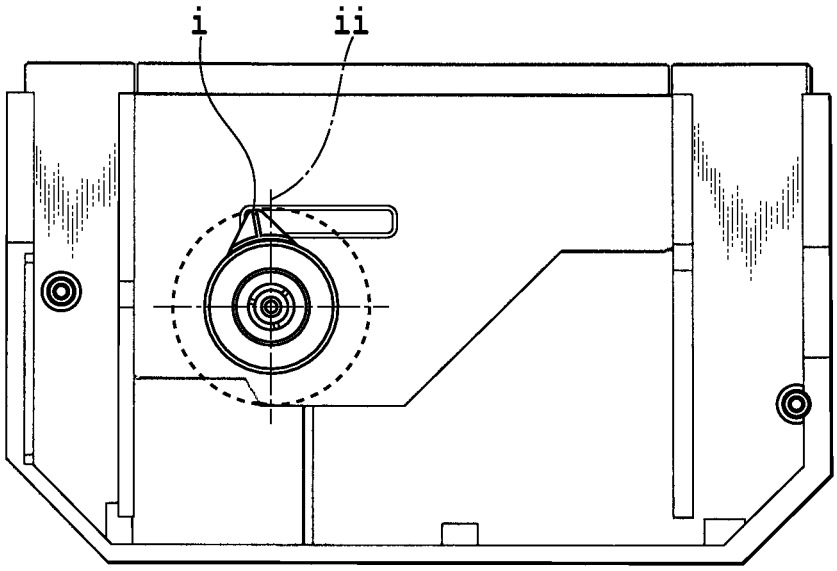
FIG. 10 shows the state of the print head replacement arm when the print head replacement cover is closed.

Next, the positional relation between the print head replacement cover 55 and the print head replacement arm 573 will be explained. FIG. 10 shows the state of the print head replacement arm 573 when the print head replacement cover 55 is open. While the drive source 545 is supplying air into the ink tank, the print head replacement arm 573 interlocked with the drive source rotates in a direction that closes the print head replacement cover 55. So, while the printing apparatus 1 is supplied ink during operation, the print head replacement cover 55 is always closed and cannot be opened. To open the print head replacement cover 55 the print head replacement arm 573 must be rotated from position i until it passes beyond position ii.

Therefore, if the user attempts to open the print head replacement cover 55 while the printing apparatus 1 is at rest (in a power-off state), the print head replacement arm 573 exerts a force that keeps the print head replacement cover 55 closed. That is, when the printing apparatus 1 is not in operation, the print head replacement cover 55 is closed and cannot be opened. This construction can prevent the user from inadvertently opening the print head replacement cover 55 and replacing the print head 7.

Figure 11:
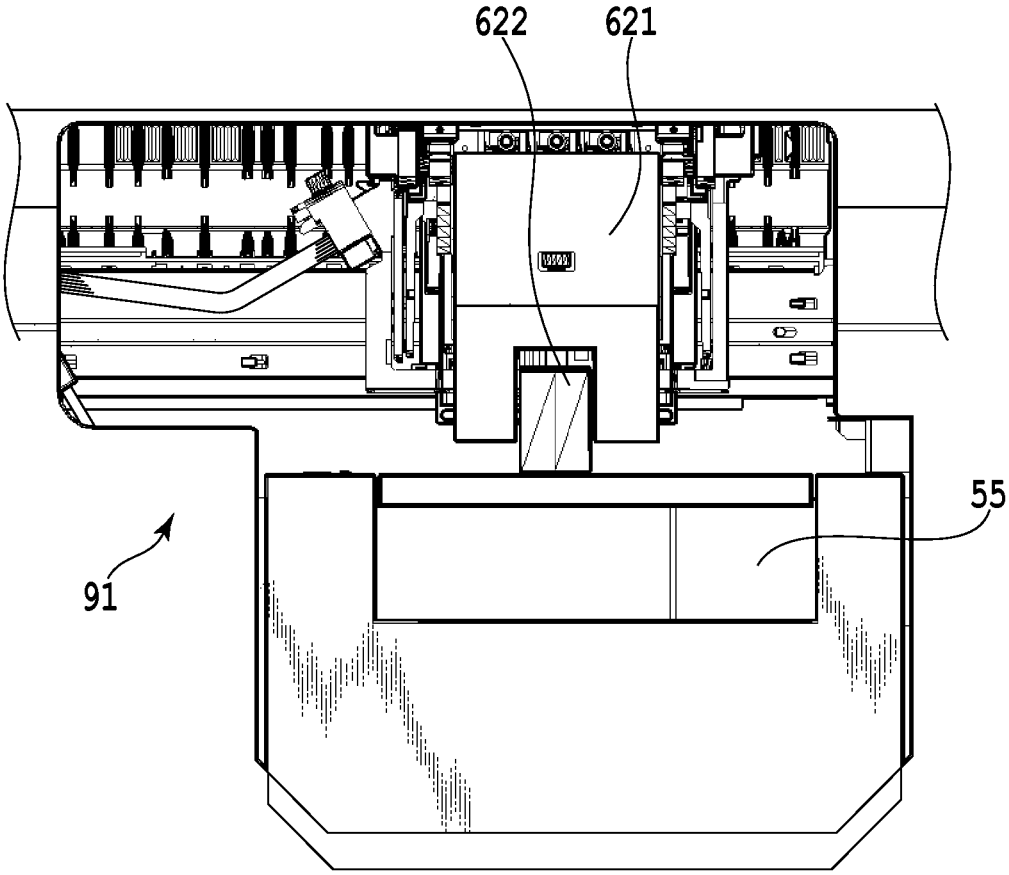
FIG. 11 is a top view showing the states of the carriage unit and the print head replacement cover while the printing apparatus is in operation.
Figure 12A:
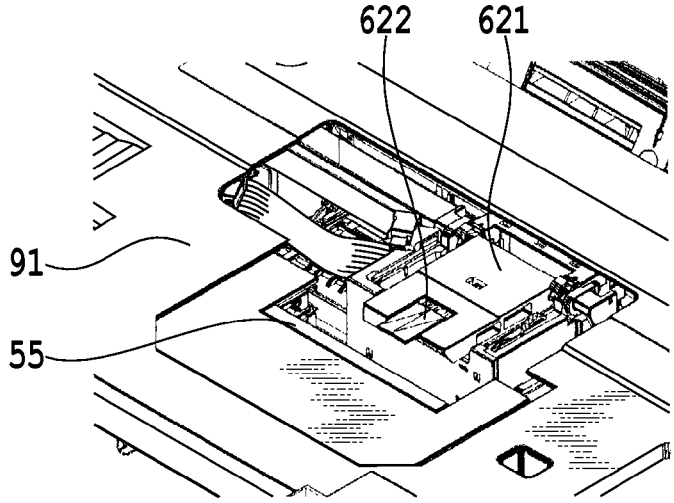
FIG. 12A is a perspective view showing a sequence of operations for the print head replacement.
Figure 12B:
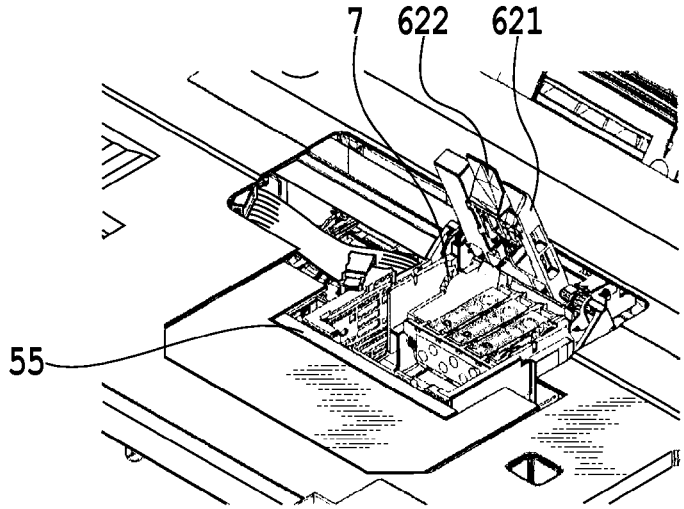
FIG. 12B is a perspective view showing a sequence of operations for the print head replacement.
Figure 12C:
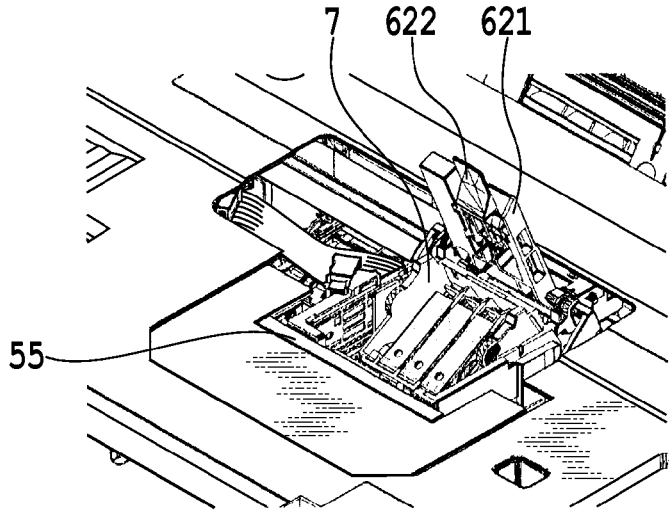
FIG. 12C is a perspective view showing a sequence of operations for the print head replacement.

Next, a series of steps for replacing the print head will be explained by referring to FIG. 11 and FIGS. 12A, 12B and 12C. FIG. 11 is a top view showing the state of the carriage unit and the print head replacement cover 55 while the printing apparatus 1 is in operation. FIGS. 12A to 12C are perspective views showing a sequence of operation for replacing the print head. A middle frame 91 is formed at one part with a recess which, if a print medium should fail to be discharged, provides a space for the user to take out the jammed print medium by opening an access cover.

With this construction, the print medium can be removed, reinstating the printing apparatus back to normal. At this time since the lever lock 622 and the print head replacement cover 55 overlap each other, the user cannot open the set lever 621 using the lever lock 622 as in FIG. 5A. With this construction, while the printing apparatus is in operation or in power-off state, the print head 7 cannot be removed from the carriage 60, preventing the user from inadvertently replacing the print head 7.

While FIG. 11 shows a construction in which a part of the lever lock 622 and the print head replacement cover 55 overlap, other construction may be used in which at least a part of the set lever 621 overlaps the print head replacement cover 55. After the print head replacement sequence shown in FIG. 3 is finished, the print head replacement cover 55 is open, which means that the overlapping between the lever lock 622 and the print head replacement cover 55 is eliminated (FIG. 12A).

The user can now rotate the set lever 621 by using the lever lock 622 (FIG. 12B). With the set lever 621 rotated, the user can take out the print head 7 (FIG. 12C). This construction enables the user to replace the print head 7 easily without erring in the replacement procedure. Further, since the print head replacement cover 55 is always closed while the printing apparatus 1 is in operation or at rest, there is no possibility of the user inadvertently replacing the print head 7.

After, with the print head 7 replaced, the access cover is closed and an access cover sensor detects its closure, the operation of closing the print head replacement cover 55 and the ink supply operation are executed. Here it is desired that the drive control to close the air pressure release valve 544 (see FIG. 2) be executed after the print head replacement cover 55 is closed.

Before the print head replacement cover 55 is closed, the air pressure release valve 544 is kept open so as to prevent air from being supplied into the ink tank. This prevents the possible splashing of ink from the joint base 61 (see FIG. 5A) even if the print head 7 is inadvertently taken out while the print head replacement cover 55 is being closed.

As described above, the ink supply operation and the opening and closing of the print head replacement cover are performed by one drive source rotating in a predetermined direction. This process can realize a fail-safe design that not only forestalls the execution by the user of the head replacement operation in an erroneous sequence while the printing apparatus is in operation but also prevents the splashing of ink even if the user inadvertently attempts to replace the print head.

(Other Embodiments)

Next, an embodiment will be explained which has installed in the printing apparatus a device for stirring ink in the ink tank. FIG. 13 shows the ink supply operation and the operation states of the print head replacement cover 55 and the ink stirring device according to the direction in which the drive source is rotating. At one end of the print head replacement cover shaft 56 is installed a drive device to stir ink in the ink tank 50 through a drive device that transmits a drive force in only one rotation direction.

When the drive source 545 is rotating in the first rotation direction, air is supplied into the ink tank 50 pressurizing the interior of the ink tank 50 and at the same time the print head replacement cover 55 is closed. At this time, no stirring operation is performed. When the drive source 545 is rotating in the second rotation direction, the air pressure release valve 544 is opened, stopping the supply of air and releasing the pressure in the ink tank 50 into the open air. At the same time, the print head replacement cover 55 is also opened. At this time the stir device is operated. During the stirring operation, the print head replacement cover 55 is opened, giving rise to a possibility of the user inadvertently replacing the print head 7.

So, the carriage 60 is retracted to an area the user cannot access, so that the user cannot inadvertently replace the print head 7 even if the print head replacement cover 55 is open during the stirring operation. It is also possible to move the carriage 60 to a retracted position where the carriage 60 engages and is locked by a carriage lock 81 (locking member). This also produces the similar effect.

Because the different drive controls are performed by different rotation directions of one drive source 545, if a motor or the drive source 545 fails, the user cannot replace the print head 7, forestalling the possible leakage of ink. Further, the provision of the drive device for stirring the ink in the ink tank 50 prevents ink concentration unevenness, that would otherwise be caused by ink colorant sedimentation, and degradations of printed image quality.

As described above, the ink supply, the opening and closing of the print head replacement cover and the stirring of ink are performed by the rotation of one drive source in a predetermined direction. This process can realize a fail-safe design that not only forestalls the execution by the user of the head replacement operation in an erroneous sequence while the printing apparatus is in operation but also prevents the splashing of ink even if the user inadvertently attempts to replace the print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-210364, filed Sep. 11, 2009, which is hereby incorporated by reference herein in its entirety.

What is claimed is:

1. A printing apparatus comprising:

a carriage capable of mounting an ink ejecting print head;

an ink storage device for storing the ink;

an ink supply device to supply the ink from the ink storage device to the print head by activating a drive source to deliver air into the ink storage device for its pressurization; and a cover covering at least a part of a member, the member being adapted to cover the print head when closed;

wherein an operation of the drive source causes the cover to be opened and closed;

wherein an operation of the drive source causes the ink storage device to be pressurized and the cover to be closed;

wherein an operation of the drive source causes the pressure in the ink storage device to be released and the cover to be opened;

wherein, when the ink supply device is delivering air to the ink storage device for its pressurization, the cover cannot be opened.

2. A printing apparatus according to claim 1, further comprising:

a first mode in which a rotation of the drive source in a first rotation direction causes the ink supply device to deliver air into the ink storage device for its pressurization and also causes the cover to be closed; and a second mode in which a rotation of the drive source in a second rotation direction causes the ink supply device to release pressurized air from the ink storage device and also causes the cover to be opened.

3. A printing apparatus according to claim 1, wherein, when the printing apparatus is at rest, the cover is closed.

4. A printing apparatus according to claim 1, wherein the drive source has a friction pad that drives the cover by a friction force.

5. A printing apparatus according to claim 1, wherein, after the cover is closed, the ink stored in the ink storage device is supplied to the print head.

6. A printing apparatus according to claim 1, further comprising:

an ink stirring device to stir the ink stored in the ink storage device by the operation of the drive source;

wherein, when the ink stirring device is operated, the air in the ink storage device pressurized by the ink supply device is released.

7. A printing apparatus according to claim 6, further comprising:

a moving device to move the carriage in a predetermined direction;

wherein, when the ink stirring device is operated, the moving device moves the carriage to a position that cannot be accessed by the user.

8. A printing apparatus according to claim 6, further comprising:

a locking member to restrict the movement of the carriage by engaging the locking member; and wherein, when the ink stirring member is operated, the locking device restricts the movement of the carriage.

9. A printing apparatus comprising:

a carriage configured to mount a print head;

an operation member which moves between a state to fix the print head to the carriage and a state which allows the printing head to be attached to and detached from the carriage;

an ink storage device storing ink to be supplied to the print head;

a pressure member pressurizing the ink storage device;

a cover which can move to a first position where the operation member cannot be operated and a second position where the operation member can be operated; and a drive source rotatable in first and second directions and configured to drive the pressure member and the cover, such that when the drive source rotates in the first direction, the pressure member performs the pressurization operation and the cover moves to the first position, and such that when the drive source rotates in the second direction, the pressure member does not perform the pressurization operation and the cover moves to the second position.

10. A printing apparatus according to claim 9, wherein, when the printing apparatus is at rest, the cover is in the first position.

11. A printing apparatus according to claim 9, wherein the drive source has a friction pad that drives the cover by a friction force.

12. A printing apparatus according to claim 9, wherein, after the cover moves to the first position, ink stored in the ink storage device is supplied to the print head.

13. A printing apparatus according to claim 9, further comprising:

an ink stirring device to stir ink stored in the ink storage device by the operation of the drive source;

wherein, when the ink stirring device is operated, air in the ink storage device pressurized by the ink supply device is released.

14. A printing apparatus according to claim 13, further comprising:

a moving device to move the carriage in a predetermined direction;

wherein, when the ink stirring device is operated, the moving device moves the carriage to a position that cannot be accessed by the user.

15. A printing apparatus according to claim 14, further comprising:

a restricting member to restrict the movement of the carriage by engaging the restricting member;

wherein, when the ink stirring device is operated, the restricting member restricts the movement of the carriage.

* * * * *